US005662455A

United States Patent [19]

Iwata et al.

[11] Patent Number: 5,662,455

[45] Date of Patent: Sep. 2, 1997

[54] FUEL PUMP ASSEMBLY HAVING REDUCED VAPOR DISCHARGE NOISE

[75] Inventors: Kouichi Iwata; Kiyoshi Kato; Takehide Nakamura, all of Obu, Japan

[73] Assignee: Aisan Kogyo Kabushiki Kaisha, Obu, Japan

[21] Appl. No.: 667,952

[22] Filed: Jun. 19, 1996

[30] Foreign Application Priority Data

Jun. 23, 1995 [JP] Japan ..... 7-157638

[51] Int. Cl.[6] ..... F04D 9/00

[52] U.S. Cl. ..... 415/55.1; 415/169.1

[58] Field of Search ..... 415/55.1, 55.2, 415/55.3, 55.4, 169.1; 123/516, 497

[56] References Cited

U.S. PATENT DOCUMENTS 5,284,417 2/1994 Yu ..... 415/55.1
5,330,319 7/1994 Yu et al. ..... 415/55.1
5,338,151 8/1994 Kemmner et al. ..... 415/55.1
5,391,062 2/1995 Yoshioka ..... 415/55.1

FOREIGN PATENT DOCUMENTS 6-140073 4/1994 Japan .

*Primary Examiner*—Thomas N. Moulis
*Attorney, Agent, or Firm*—Dennison, Meserole, Pollack & Scheiner

[57] ABSTRACT

A fuel pump assembly having a vapor by-pass port communicating a pump chamber with the interior of a fuel tank, which comprises a vapor introducing passage for introducing the vapor-mixed fuel discharged through the vapor by-pass port, a vapor discharge port communicating with the midway of the vapor introducing passage and opening to the interior of the fuel tank, and a bag-like closed space formed on a rear half portion of the vapor introducing passage. The vapor discharge noise is effectively reduced with the construction.

6 Claims, 7 Drawing Sheets

FIG. 1(a)

FUEL PUMP ASSEMBLY HAVING REDUCED VAPOR DISCHARGE NOISE

BACKGROUND OF THE INVENTION

1. Field of the Invention

This invention relates to a fuel pump assembly suitably used in a vehicle, and more particularly, to a fuel pump assembly in which discharge noise of vapor generated in fuel is reduced.

2. Description of the Prior Art

Referring to FIGS. 6 to 9, a conventional fuel pump assembly 2 will be described. The fuel pump assembly 2 shown in FIG. 6 and FIG. 7 representing, respectively, a sectional side view and a bottom end view, comprises a cylindrical metal housing 8, a motor section 10 disposed at an upper part of the housing 8, and a pump section 14 disposed at a lower part thereof. The motor section 10 and the pump section 14 are separated by an aluminum die-cast cover member 12. The fuel pump assembly 2 is mounted in a fuel tank (not shown) through a metal bracket 6 substantially in a vertical manner.

The motor section 10 is composed of an electric motor having a rotor 16 and a driving shaft 18. In the pump section 14, the driving shaft 18 is inserted through a hole formed in the central portion of the cover member 12. The driving shaft 18 has mounted thereon a first impeller 20 and a second impeller 22 rotatable in association with the driving shaft 18. The impellers 20 and 22 are made of synthetic resin each having a plurality of cutout portions or vanes (not numbered) along the outer periphery thereof. The cover member 12, an aluminum die-cast fixing plate 28, and a housing body 226 are fixed at the bottom part of the housing 8 by caulking the bottom end periphery thereof.

As should be apparent from the drawings, the cover member 12, the fixing plate 28, and the housing body 226 are integrally assembled to form a first pump chamber 42 and a second pump chamber 44 each having a substantially C-shaped section along the respective outer periphery of the impellers 20 and 22. The pump chambers 42 and 44 communicate with each other by a through hole (not shown) formed in the fixing plate 28. The second pump chamber 44 communicates with the interior of the housing 8 through an outlet port 246 formed in the cover member 12. On the other hand, the first pump chamber 42 communicates with the interior of a fuel tank through an inlet port 248 formed in the housing body 226. The inlet port 248 is connected to a fuel filter 31.

FIG. 8 is a bottom end view of the fuel pump assembly 2 with a part broken away, and FIG. 9 is a sectional side view of the housing body 226. The housing body 226 has a small vapor by-pass port 250 communicating with the first pump chamber 42. The vapor by-pass port 250 serves for discharging vapor from the fuel flow in the first pump chamber 42 to the outside thereof and this port is bored by drilling at a predetermined angle at a location apart from the inlet port 248.

The housing body 226 has a chamber 262 formed at the outlet side of the by-pass port 250. The chamber 262 is formed such that a recess 252 having a bore diameter larger than that of the vapor by-pass port 250 is drilled and then, a bottom opening of the recess 252 is covered by a metal or resin cover plate 253. The plate 253 is fitted by press-fitting or the like.

The housing body 226 has a small restriction 260 formed at a side surface of the chamber 262 by drilling or the like so as to radially pass through the wall of the chamber 262 (substantially perpendicular to the vapor by-pass port 250). Accordingly, the chamber 262 is opened to the interior of the fuel tank.

As shown in FIG. 6, the fuel pump assembly 2 is mounted on the bracket 6 with a rubber cushion material 54 inserted at the bottom of the housing body 226. The cushion material 54 prevents vibrations of the fuel pump assembly 2 from being transmitted to the bracket 6.

The effects of the fuel pump assembly thus constructed will now be described. When the motor section 10 is driven to rotate the impellers 20 and 22, the fuel is increased in pressure in the first pump chamber 42, and is introduced into the second pump chamber 44 through the through hole formed in the fixing plate 28. The fuel is further increased in pressure in the second pump chamber 44.

Under the two-step pressure increasing action attained by the rotations of the impellers 20 and 22, the fuel is sucked from the inlet port 248 and is pumped from the outlet port 246 into the housing 8 passing through both the pump chambers 42 and 44. The fuel thus pumped into the housing 8 is further fed forcedly to an engine (not shown).

In this conventional pump, the vapor generated by temperature rise in the fuel tank and by the above-described fuel sucking effect is discharged, as a vapor-mixed fuel, from the pump chamber 42 through the vapor by-pass port 250 of the housing body 226 into the chamber 262, and is then discharged into the fuel tank through the restriction 260. With this construction, the vapor content rate in the fuel fed from the housing 8 to the engine is naturally reduced, thus preventing a vapor-lock of the engine or the fuel pump.

The above-described fuel pump assembly 2 is disclosed, for example, in Japanese Utility Model Publication No. 6-14073 proposed by the same assignee as the present invention. The provision of the fuel pump assembly 2 in the fuel tank is disclosed in the Japanese Utility Model Publication No. 6-14073, and its description will not be repeated.

In the fuel pump assembly 2 thus constructed, discharge noise caused by the vapor-mixed fuel passing through the vapor by-pass port 250 is reduced to some degree by the chamber 262.

However, the shape of the chamber 262 is so simple that the reduction of the discharge noise is not enough. Furthermore, the area of the restriction 260 must be small in order to efficiently keep the noise reduction effect brought about by the chamber 262, thus prohibiting the gentle discharge speed of the vapor-mixed fuel from the restriction 260. Therefore, noise and vibrations are also generated when the energetically released vapor-mixed fuel impinges the bracket 6 or a wall surface of a subtank accommodating the fuel pump assembly 2 and the fuel filter 31.

SUMMARY OF THE INVENTION

It is, accordingly, an object of the present invention to provide a fuel pump assembly in which noise and vibrations are reduced.

According to one aspect of the invention, there is provided a fuel pump assembly having a motor, an impeller rotated by said motor, and a housing body surrounding said impeller for forming a pump chamber. The housing body is provided with a vapor by-pass port communicating with said pump chamber, a vapor introducing passage communicating with said vapor by-pass port, and a vapor discharge port communicating said vapor introducing passage with the interior of a fuel tank. The vapor by-pass port communicates with said vapor introducing passage in the vicinity of one end of the vapor introducing passage. The other end of said vapor introducing passage is formed into a bag-like space having a closed end.

According to this aspect, the vapor-mixed fuel discharged from the pump chamber through the vapor by-pass port is introduced into the vapor introducing passage and into the bag-like closed space provided therein. With this construction, the vapor discharge noise is sufficiently reduced.

The present invention will be more fully understood from the following detailed description and appended claims when taken with the accompanying drawings.

BRIEF DESCRIPTION OF THE DRAWINGS

FIG. 1(*b*) is a vertical sectional view of the essential part thereof;

DETAILED DESCRIPTION OF THE PREFERRED EMBODIMENTS

A fuel pump assembly will now be described according to a first and a second embodiment of the present invention.

Figure 1A:
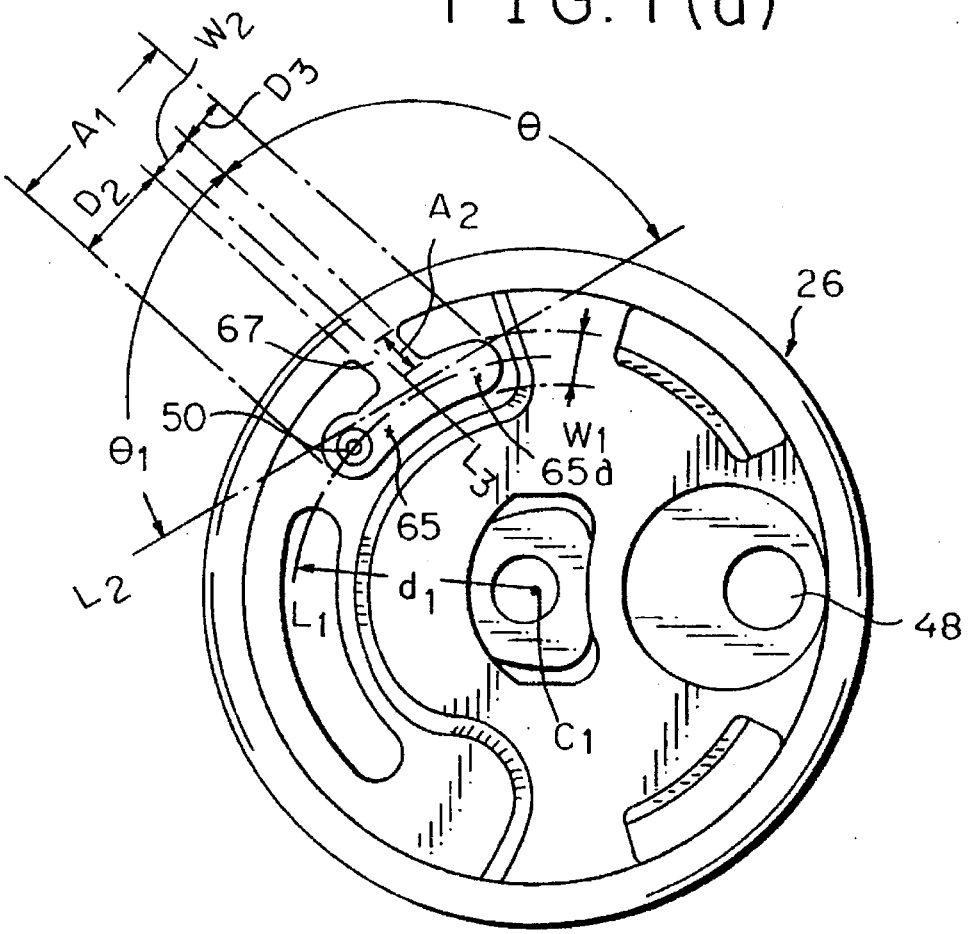
FIG. 1(*a*) is a bottom view of a housing body of a fuel pump assembly according to a first embodiment of the present invention.
Figure 1B:
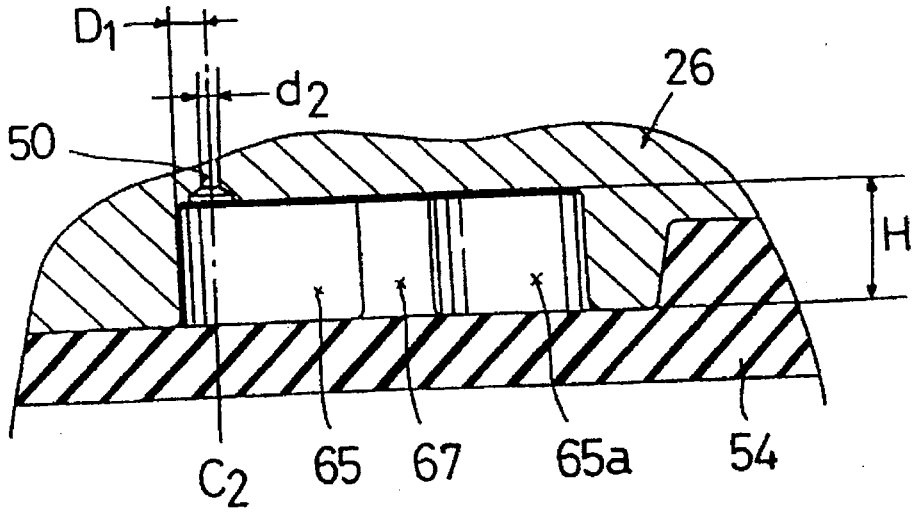
Figure 2A:
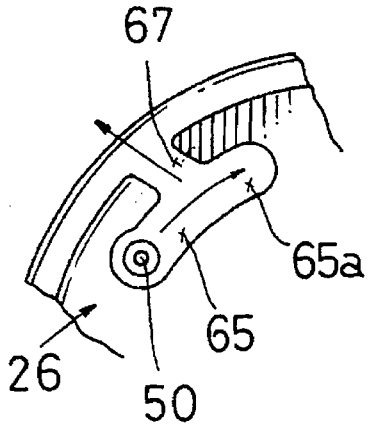
FIGS. 2(*a*) and 2(*b*) are explanatory views showing vapor-mixed fuel flow.
Figure 2B:
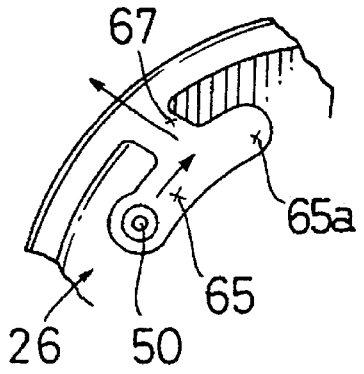

The first embodiment will be described with reference to FIGS. 1 to 4. FIG. 1(*a*) is a bottom end view of a housing body 26, and FIG. 1(*b*) is a sectional view of the essential part thereof. The fuel pump assembly of this embodiment is an improvement of the above described conventional one. Parts that are the same as or similar to the conventional fuel pump are given like reference numbers, and their description will not be repeated.

In FIGS. 1(*a*) and 1(*b*), the housing body 26 is formed, on the bottom surface thereof, is a vapor introducing passage 65 communicating with a vapor by-pass port 50. The vapor introducing passage 65 is formed into an arc-shaped space whose arced-center line $L_1$ is a part of a circumference having its center on a central axis $C_1$ (See FIG. 1(*a*)) of the housing body 26 and intersecting a central axis $C_2$ (See FIG. 1(*b*)) of the vapor by-pass port 50. The vapor by-pass port 50 is formed by drilling in the vicinity of one end of the vapor introducing passage 65. In the vapor introducing passage 65, a side where the vapor by-pass port 50 exists (left side in FIG. 1) is referred to as a front side and the opposite side (right side in FIG. 1) is referred to as a rear side, for the sake of explanation. Here, impellers 20 and 22 are rotated in a counterclockwise direction as viewed in FIG. 1. The vapor introducing passage 65 extends from the vapor by-pass port 50 in a rotational direction opposite to that of the impellers 20 and 22.

A vapor discharge port 67 communicates with a substantially central portion of the outer peripheral wall of the vapor introducing passage 65 and opens to an outer peripheral surface of the housing body 26 (or to the interior of a fuel tank). In addition, a bag-like closed space 65*a* is formed on the rear side of the vapor introducing passage 65.

The vapor discharge port 67 is a linear passage having a predetermined length. Though being arc-shaped, the vapor introducing passage 65 can be regarded as a linear passage because of its relatively large width. The vapor discharge port 67 is inclined at an acute angle $\theta_1$ (See FIG. 1(*a*)) relative to the vapor introducing passage 65.

The angle $\theta_1$ is formed by a center line $L_3$ of the vapor discharge port 67 and a tangent line $L_2$ of the arc-shaped center line $L_1$ of the vapor introducing passage 65 intersecting the center line $L_3$. In this embodiment, $\theta_1$ is set to be 68 degrees.

The vapor introducing passage 65 and the vapor discharge port 67 are formed such that, when the housing body 26 is die-cast, it is formed in advance with a substantially T-shaped passage recess having a U-shaped cross section which corresponds to a combination shape of the vapor introducing passage 65 and the vapor discharge port 67. The passage recess is covered with a cushion material 54.

Figure 6:
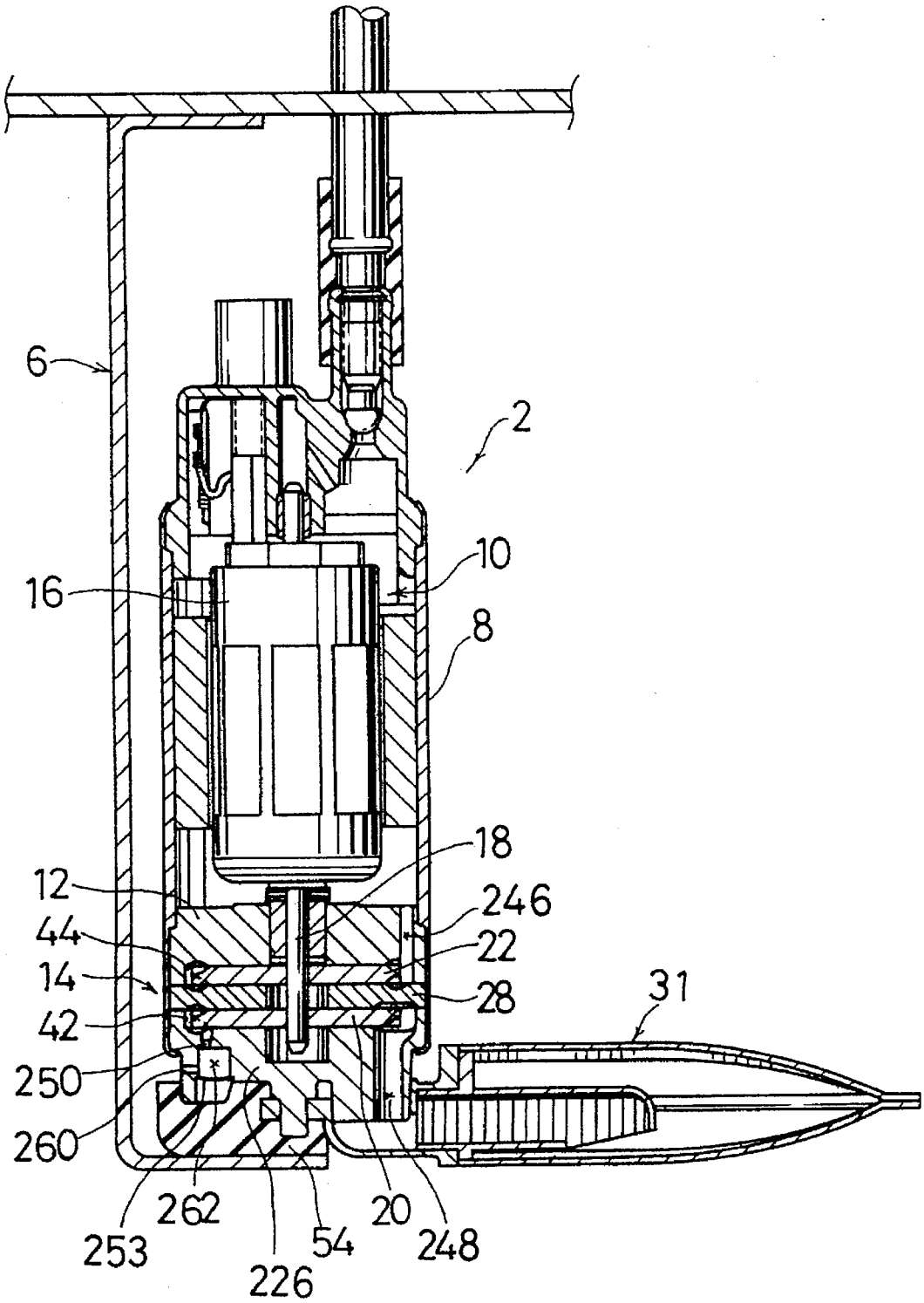
FIG. 6 PRIOR ART
FIG. 6 is a sectional view of a conventional fuel pump assembly.
Figure 7:
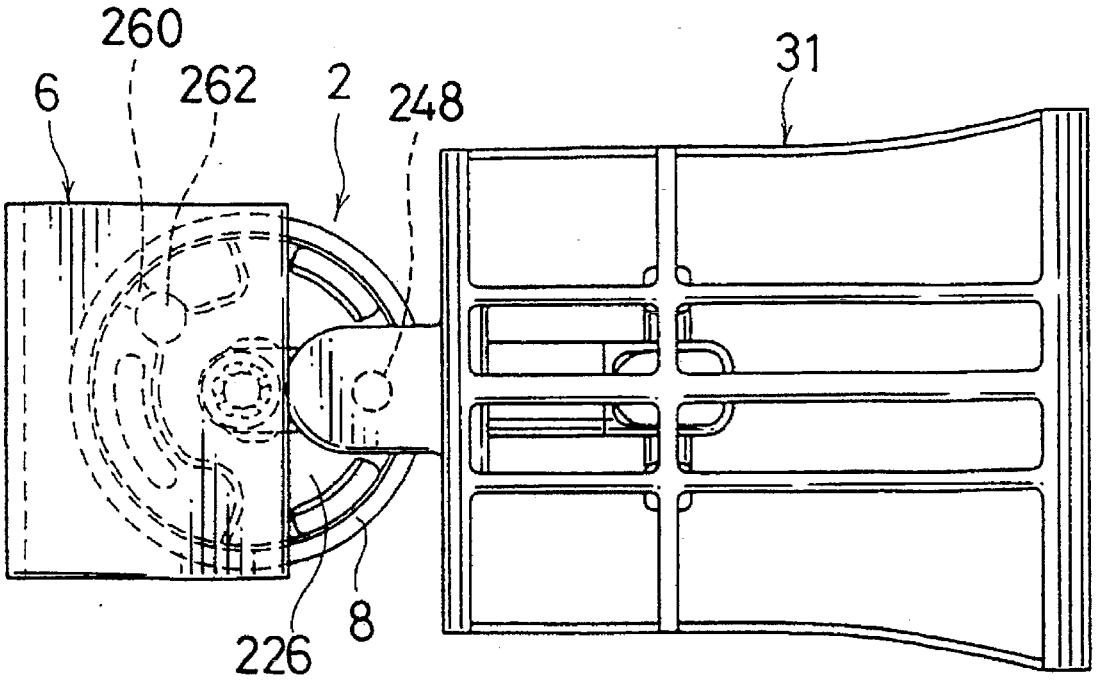
FIG. 7 PRIOR ART
FIG. 7 is a bottom end view of the conventional fuel pump assembly shown in FIG. 6.
Figure 8:
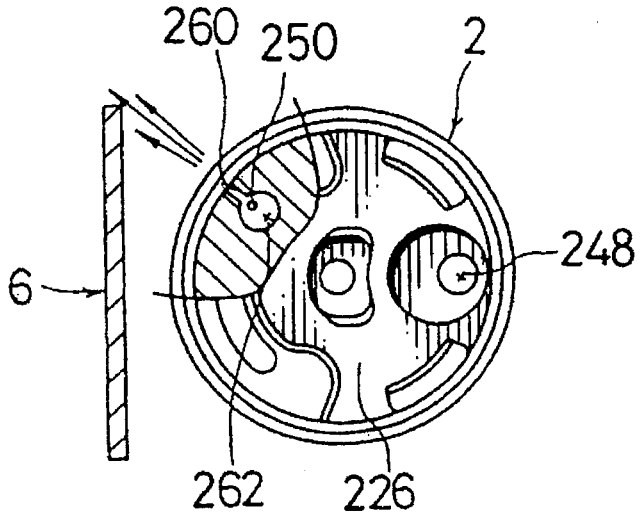
FIG. 8 PRIOR ART
FIG. 8 is a bottom end view of the conventional fuel pump assembly with a part broken away shown in FIG. 6.

With this construction, the passage recess can be formed simultaneously with the die-cast of the housing body 26, thus simplifying the formation process of the vapor introducing passage 65 and the vapor discharge port 67 compared with a formation process by boring. As shown in FIG. 6, the cushion material 54 disposed below the housing body 226 and serving for mounting a fuel pump 2 on a bracket 6 is also used for covering the passage recess, thus eliminating the need for preparing a separate cover material.

It should be noted that major dimensions of this embodiment are determined as set forth below. In FIG. 1(*a*), a diameter $d_1$ of the arc-shaped center line $L_1$ of the vapor introducing passage 65 is 13.0 mm, a passage width $W_1$ thereof is 3.0 mm, a length $A_1$ thereof is 10.6 mm, a passage width $W_2$ of the vapor discharge port 67 is 2.5 mm, a length $A_2$ thereof is 2.5 mm, a distance D from a front wall of the vapor introducing passage 65 to the vapor discharge port 67 is 5.5 mm, and a distance $D_3$ from a rear wall of the vapor introducing passage 65 to the vapor discharge port 67 is 2.6 mm. In FIG. 1(*b*), a diameter $d_2$ of the vapor by-pass port 50 is 1.0 mm, a distance $D_1$ from the front wall of the vapor introducing passage 65 to the center of the vapor by-pass port 50 is 2.0 mm, and both heights of the vapor introducing passage 65 and the vapor discharge port 67 are 6.0 mm.

According to the fuel pump assembly of this embodiment, vapor-mixed fuel discharged from a pump chamber 42 through the vapor by-pass port 50 is introduced into the vapor introducing passage 65, and is then closed within the bag-like space 65*a* thereof. Thus, the vapor-mixed fuel is reduced in flow speed and is calmly released from the vapor discharge port 67 into the fuel tank at a slow release speed. Specifically, when flowing at a high speed, the vapor-mixed fuel first reaches the vicinity of the bag-like closed space 65*a* of the vapor introducing passage 65, and is then released from the vapor discharge port 67 as shown by an arrow in FIG. 2(*a*) after it is reduced in flow speed. By way of contrast, when flowing at a low speed, the vapor-mixed fuel is released from the vicinity of an entrance of the bag-like closed space 65*a* of the vapor introducing passage 65 through the vapor discharge port 67, as shown by an arrow in FIG. 2(*b*).

With this construction, the area of the vapor discharge port 67 is much larger than the area of the vapor by-pass port 50. Therefore, the discharge speed from the vapor discharge port 67 is sufficiently reduced.

Figure 9:
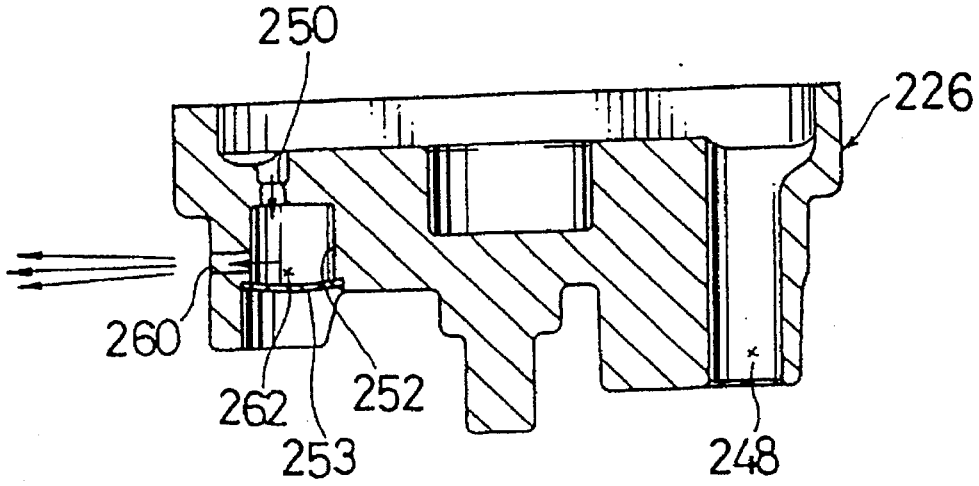
FIG. 9 PRIOR ART
FIG. 9 is a vertical sectional view of the housing body shown in FIG. 6.

In the conventional chamber construction shown in FIG. 9, when the area of the restriction 260 is large, the noise reduction effect brought about by the chamber 262 is lowered. By way of contrast, a good noise reduction effect can be maintained by the construction of this embodiment, even when the area of the vapor discharge port 67 is large. Therefore, both the good noise reduction effect brought about by the chamber (or the vapor introducing passage) and the good noise reduction effect created by the low discharge speed from the vapor discharge port 67 can be obtained in this embodiment.

Further, the inclination $\theta_1$ of the vapor discharge port 67 relative to the vapor introducing passage 65 is set to an acute angle (68 degrees in this embodiment) so that a bend of a connection of the vapor introducing passage 65 to the vapor discharge port 67 is sharp. When the inclination $\theta_1$ is 90 degrees or more, an inconvenience may occur in that the high-speed vapor-mixed fuel fails to enter the bag-like closed space 65*a* and is discharged directly to the vapor discharge port 67 from the vapor introducing passage 65 due to the smooth bend of the connection of the vapor introducing passage 65 to the vapor discharge port 67. However, in this embodiment, the sharp bend thereof prevents the above inconvenience, thus effectively reducing the discharge noise of the vapor-mixed fuel.

Figure 3:
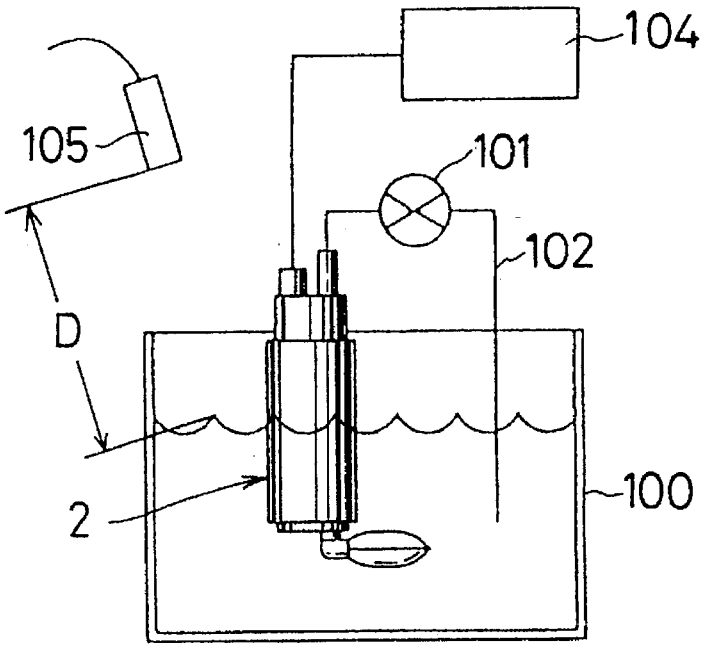
FIG. 3 is an explanatory view of a noise test unit.
Figure 4:
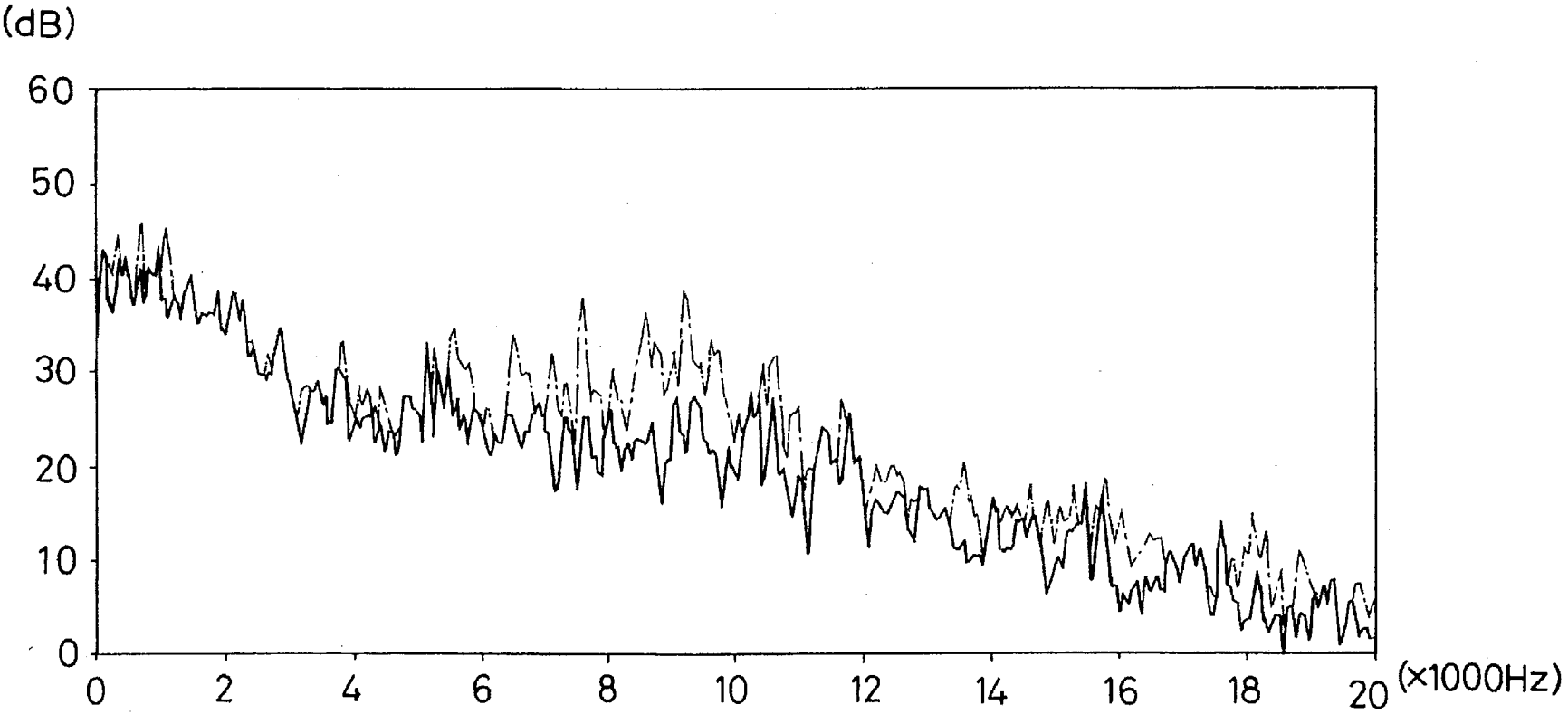
FIG. 4 is a graph showing the relation between frequency (abscissa) and sound pressure (ordinate) based on a noise test result conducted by the noise test unit.

Now, results of a noise test conducted on a conventional art pump and the above embodiment will be described. As schematically shown in FIG. 3, a test unit used in the test has a test tank 100 where fuel or gasoline is stored. The fuel pump assembly 2 is positioned in the gasoline in an immersed state. The fuel pump assembly 2 has an electric power source 104 as a driving source and a pipe 102 with a pressure regulating valve 101 connected to a pump discharge opening. Further, a microphone 105 is disposed a predetermined distance D (10 cm) apart from the level of the gasoline. In this test unit, the noise from the pump assembly 2 was collected by the microphone. FIG. 4 is a graph showing the relation between frequency and sound pressure based on the noise collection result. In FIG. 4, sound pressure fluctuation of this embodiment is shown by a solid line, and that of the conventional art pump is shown by a one-dot chain line. As clearly seen in FIG. 4, noise from the pump assembly of this embodiment is lower than that from the conventional art.

Figure 5A:
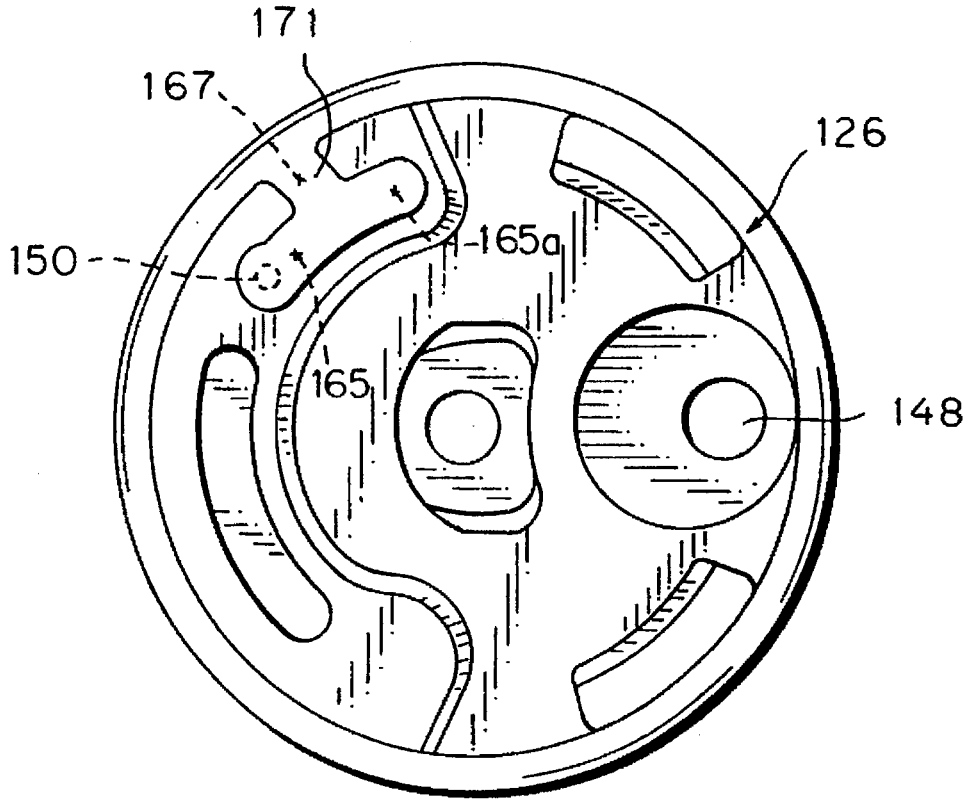
FIGS. 5(*a*) and 5(*b*) are explanatory views of a housing body according to a second embodiment of the present invention.
Figure 5B:
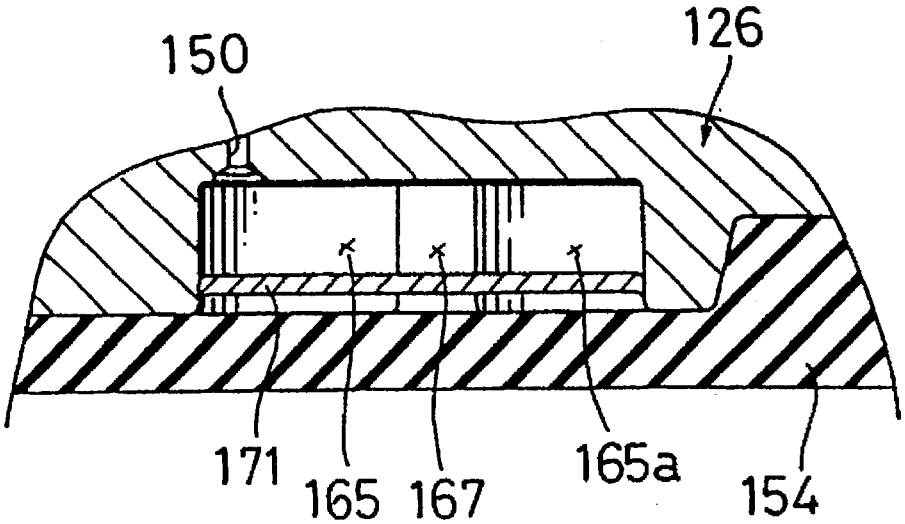

Referring to FIG. 5, a second embodiment of the present invention will be described. FIG. 5(*a*) is a bottom end view of an housing body 126, and FIG. 5(*b*) is a sectional view of the essential part thereof.

In this embodiment, a housing body 126 is formed with a vapor introducing passage 165 and a vapor discharge port 167, and a passage recess corresponding thereto is covered with a metal or resin cover plate material 171 as by press-fitting in place of a cushion material 154 as used in the first embodiment. The same operational effects are obtained by the second embodiment as those of the first embodiment.

Other than the above described embodiments, for example, the vapor introducing passages 65 and 165, and the housing bodies 26 and 126 of the respective first and second embodiments can be formed by boring such as drilling. The inclination $\theta_1$ of the vapor discharge ports 67 and 167 can be set to 90 degrees or more. Further, the length $A_2$ of the vapor discharge ports 67 and 167 can be shortened.

While the invention has been described with reference to preferred embodiments thereof, it is to be understood that modifications or variations may be easily made without departing from the scope of the present invention which is defined by the appended claims.

What is claimed is:

1. A fuel pump assembly comprising:

a motor;

an impeller rotated by said motor; and a housing body surrounding said impeller for forming a pump chamber;

said housing body having a vapor by-pass port communicating with said pump chamber, a vapor introducing passage communicating with said vapor by-pass port, and a vapor discharge port communicating said vapor introducing passage with an interior of a fuel tank;

said vapor by-pass port communicating with said vapor introducing passage in the vicinity of one end thereof, the other end of said vapor introducing passage being closed, the vapor discharge port communicating with said vapor introducing passage at a central portion between said one end and said other end of said vapor introducing passage.

2. The fuel pump assembly as defined in claim 1, wherein said vapor introducing passage and said vapor discharge port intersect each other at an acute angle.

3. The fuel pump assembly as defined in claim 1, wherein said vapor introducing passage extends from said vapor by-pass port in a rotational direction which is opposite to the direction said impeller is rotated.

4. A fuel pump assembly comprising:

a motor;

an impeller rotated by said motor in a first direction; and a housing body surrounding said impeller for forming a pump chamber;

said housing body having a vapor by-pass port communicating with said pump chamber, a vapor introducing passage communicating with said vapor by-pass port, and a vapor discharge port communicating with said vapor introducing passage with an interior of a fuel tank;

said vapor by-pass port communicating with said vapor introducing passage in the vicinity of a first end thereof, a second end of said vapor introducing passage being closed, the vapor discharge port communicating with said vapor introducing passage at a central portion between said first end and said second end of the vapor introducing passage.

5. The fuel pump assembly as defined in claim 4, wherein said vapor introducing passage and said vapor discharge port intersect each other at an acute angle.

6. The fuel pump assembly as defined in claim 5, wherein said vapor introducing passage extends from said vapor by-pass port in a second rotational direction which is opposite to the first direction said impeller is rotated.

* * * * *